US005297624A

United States Patent [19]

Haussmann et al.

[11] Patent Number: 5,297,624

[45] Date of Patent: Mar. 29, 1994

[54] HEADER FOR A FLAT TUBE LIQUEFIER

[75] Inventors: Roland Haussmann, Wiesloch; Hans Huber, Horrenberg, both of Fed. Rep. of Germany

[73] Assignee: Thermal-Werke Wärme-, Kälte-, Klimatechnik GmbH, Hockenheim, Fed. Rep. of Germany

[21] Appl. No.: 906,886

[22] Filed: Jul. 2, 1992

[30] Foreign Application Priority Data

Jul. 2, 1991 [DE] Fed. Rep. of Germany ..... 4121877
Nov. 11, 1991 [DE] Fed. Rep. of Germany ..... 4137037

[51] Int. Cl.[5] ..... F28F 9/02

[52] U.S. Cl. ..... 165/173; 165/79; 165/176; 228/166

[58] Field of Search ..... 165/173, 176, 79; 29/890.052; 228/166

[56] References Cited

FOREIGN PATENT DOCUMENTS

| | | |
|---|---|---|
| 0255313 | 2/1988 | European Pat. Off. . |
| 0374896 | 6/1990 | European Pat. Off. . |
| 379701 | 8/1990 | European Pat. Off. . |
| 3843306 | 6/1990 | Fed. Rep. of Germany . |
| 9015090 | 2/1991 | Fed. Rep. of Germany . |
| 56-56595 | 5/1981 | Japan . |
| 58-195793 | 11/1983 | Japan . |
| 2-176397 | 7/1990 | Japan . |
| 3-36497 | 2/1991 | Japan . |
| 2025023 | 1/1980 | United Kingdom . |
| 2082312 | 3/1982 | United Kingdom . |

*Primary Examiner*—Allen J. Flanigan
*Attorney, Agent, or Firm*—Spencer, Frank & Schneider

[57] ABSTRACT

A header for a flat tube liquefier is composed of first and second components. The first component is provided in a tube bottom with receiving slots for the flat tubes and the second component complements the header structure, with the two components following one another in two overlap zones that extend along the length of the header and seal the two components against each other. A solder connection is provided in the respective overlap zone. If in these two overlap zones the first component is arranged to lie on the outside and the second component on the inside, the first component grips around the second component toward the interior and/or the second component is disposed completely within the outer width dimension of the first component. Moreover, beads may be formed in the tube bottom at both sides of the respective receiving slot at the side of the receiving slot that faces away from the curvature of the tube bottom. These beads end in the end region of the curvature of the tube bottom and are pressed against the respectively inserted flat tube in the direction of the curvature of the tube bottom while deforming the material of the periphery of the receiving slots.

39 Claims, 8 Drawing Sheets

HEADER FOR A FLAT TUBE LIQUEFIER

BACKGROUND OF THE INVENTION

The invention relates to a header for a flat tube liquefier disclosed, for example, in German Utility Model Patent G 90 15 090.2. This header is based on the object of having the exterior width dimension of the header exceed as little as possible the length dimension of the cross section of the flat tubes to be inserted into the header. For this purpose, the first component which is provided with the tube bottom for the flat tubes is surrounded in a fork-like fashion by the second component, with it being possible to configure the outer arm of the respective fork-like enclosure with a relatively thin wall thickness. Compared to European published Patent Application EP-A2-0,374,896 —and comparable other prior art—the total depth of the liquefier comprising the header, the flat tubes and ribs thereon was reduced. In EP-A2-0,374,896, the first component is disposed on the inside and the second component on the outside in the two overlap zones between the first component and the second component, and the free edges of the second component are surrounded toward the exterior by the first component. A comparable arrangement of the first component, which is provided with the tube bottom, on the inside with respect to the second component that complements the header is also incorporated in other prior art structures in which the header is composed of two overlapping complemental components. Regarding the structural depth of the flat tube liquefier, a general construction difficulty has arisen in connection with such headers that are composed of two parts, for example, compared to European Patent EP-B1-0,255,313, Where the header is composed of a one-piece round tube and thus is not involved in any case with increases in the structural depth due to overlapping wall thicknesses. On the other hand, however, such an integral header has the drawback that it is not possible to widen the flat tubes from the interior of the header toward the receiving slots, which is desirable for reliable and secure soldering, and is even a prerequisite in practice for soldering under vacuum conditions. Another difficulty in the use of slotted integral tubes is that it is extremely difficult to subsequently properly produce receiving slots for flat tubes in these tubes. The practical realization of EP-B1-0,255,313 now in existence therefore uses the expensive detour, which is difficult from a manufacturing aspect, of initially stamping the receiving slots into a still flat sheet metal and to then shape this metal sheet into a round tube and weld it at a sloping abutment edge. In contrast thereto, with headers that are assembled of two parts, to which the invention relates, it is possible to work without difficulty from the interior of the header toward the first component that forms the tube bottom, also to stamp out the receiving slots for the flat tubes, and to then tightly seal the header with the second component. However, the stamping out of the receiving slots may also be effected when the sheet metal is still in the flat state without it then being necessary to deform this sheet metal with the complicated butt welding process into a single tube as is the case in EP-B1-0,255,313.

In the header of EP-A2-0,374,896 as well as in the header of German Utility Model Patent G 90 15 090.2, the connection between the two components is realized by a fork-shaped pocket into which a wall of the other component is inserted. In the case of EP-A2-0,374,896, the sheet metal walls of both components are pressed together after they have been assembled. In the header according to German Utility Model Patent G 90 15 090.2 in which the complementing second component is an extruded profile, the insertion tolerances encountered are even closer right from the start, because a subsequent compression cannot be performed. It is here necessary to overcome difficulties during assembly not only because of the close available tolerances but also because of the interacting material roughnesses. In neither of the prior art headers according to EP-A2-0,374,896 or according to German Utility Model Patent G 90 15 090.2 is there a significant positive lock which secures the two components against sliding apart during the soldering process with a relaxation of the previously performed mechanical tensioning.

SUMMARY OF THE INVENTION

Compared to the discovered prior art, the invention is based on the consideration that, because of the mentioned advantages, the structural principle of constructing a header of components that at least complement one another in the peripheral direction should be retained, but comparable conditions should be realized with respect to the structural depth of the flat tube liquefier to those in EP-B1-0,255,313. According to this European Patent the header is given only a single wall right from the start compared to the at least double-walled configuration of an overlapping connection between two components that complement one another in the peripheral direction.

In this sense, it is an object of the invention to realize in a structurally simple manner a structural depth for a flat tube liquefier as disclosed in EP-B1-0,255,313 even in a header in which two components that complement one another in the peripheral direction form an overlapping connection.

It is another object of the invention to secure, if possible, the overlapping connection of the two header components that complement one another in the peripheral direction against sliding apart during the soldering process.

The invention is based on the concept that, if the first component forming the tube bottom lies on the inside in the overlap zone and the second component which complements the header is disposed on the outside in the overlap zone, this overlap zone must be disposed on the side of the end faces of the flat tubes in the flat tube liquefier and thus considerably enlarges the structural depth of the header beyond the structural depth required solely by the flat tubes. In any case, this statement also applies if the entire tube bottom is to be utilized for the receiving slots for the flat tubes and additionally if it is desired to take advantage of the possibility of a two-part configuration of the header, in which case the flat tubes inserted into the receiving slots are additionally widened from the inside of the header. The latter precludes the free edge of the first component that is provided with the tube bottom from snapping back.

Instead, the invention utilizes in a novel manner the configuration already disclosed in German Utility Model Patent G 90 15 090.2, in which, in the two overlap zones between the two header components that complement one another in the peripheral direction, the first component forming the tube bottom is disposed on the outside and the second component is arranged to lie on the inside. While, however, in the case of German Utility Model Patent G 90 15 090.2 an additional structural depth is created by the fork-shaped configuration of the overlap zone, the present invention completely eliminates the exterior fork arm of the connection. The invention refers back to an already proven principle, employed for other prior art headers, of managing in the overlap zone with a two-layer overlap and a fork-shaped grip, that is a three-layer connection. Due to the fact that the first component grips with a positive lock around the one second component, it is possible to additionally realize an arrangement in which the solder connection is secured against sliding apart during the soldering process. This is in contrast to the embodiment according to EP-A2-0,374,986 which, in the end effect, forms only a fork-like pocket.

The two components forming the header according to the invention can be manufactured just as easily in large series as this is already the case for the two-part prior art headers. There are even certain simplifications, for example, during installation. Particularly significant is the simplification in manufacture due to the two components of the header being manufactured in an indeterminate length to then be simply cut to certain header lengths.

It appears conceivable to realize the invention by simply gripping around the body of the second component. If one is willing to accept a reduction in the free inner cross section of the second component, the first component could also grip around lateral flanges or webs on the second component. However, a solution according to the invention appears to be the best, wherein overhang portions of the first component grip around free edges that are formed on the exterior face of the second component facing away from the tube bottom of the first component. Since further a fork-shaped grip as in the case of EP-A2-0,374,896 is no longer required, a partial enclosure is sufficient to ensure the mentioned form-locking connection between the overlap zones during the soldering process. Each overhang portion may be divided into a series of holding flaps. Advisably, at least some of the holding flaps are adapted locally to existing dividing walls in the header so that the dividing walls are able to serve as abutments during the bending-over process.

In the past, it has been the custom to introduce dividing walls in the header—such as end walls and partitions—through their own insertion slots in the tube bottom (EP-B1-0,255,313) or to at least hold them in holding slots in the tube bottom (EP-A2-0,374,896). According to a further feature of the invention it is possible to arrange such partitions without any slots in the header. Instead, by rhythmically denting the tube bottom an inserted dividing wall can be held, while compensating for tolerances, in the inner hollow flute of the indentation which is configured as an external bead in the tube bottom and the dividing wall can thus be held in form-locking contact at the interior face of the first component. The rhythmic denting of the tube bottom then makes it possible to substantially freely select the position of the dividing wall. Moreover, the exterior beads act as additional stiffening means for the first component so that its wall thickness can be kept at a minimum.

According to the invention the inner curved wall faces of the first and second component which define a tubular cavity of the header, change into one another with a steady transition. This feature clarifies that all measures according to the invention can be performed without it being necessary to make steps in the transition of the inner outline of the cross section of the one component into the other component. It is even possible to provide a steady connection. This allows, for example, a selection of either the entire interior outline of the inner cross section of the header in the form of a circle—which is known to be an optimum flow related condition for pressure resistance as well as for the amount of material required—or to freely select any other configuration such as, for example, the configuration of the tube bottom as a so-called torospherical head.

Tolerance problems and soldering problems develop wherever components such as, in particular, the flat tubes of a flat tube heat exchanger, must be inserted into the tube bottom of the one component and must be soldered there. On the other hand, such problems arise in the region of the soldered overlap zone between the two components of the header of the flat tube heat exchanger. In both problem groups, it is initially necessary to establish a firm mechanical contact of the components to be connected while compensating tolerances. This should be followed by a funnel-shaped solder connection that ends in a capillary in the direction toward the firm connection. In the region of the funnel shape, fluxing agent for the solder is initially introduced. Fluxing agent is generally applied in an aqueous suspension and in this state does not yet penetrate into the capillary extension of the funnel shape. When heated in the region of the solder connection to be produced and upon evaporation of the suspension water, the fluxing agent is then initially able to penetrate into the capillary region and is followed by the solder which becomes flowable at a higher temperature. This may produce a reliable solder connection. The firm mechanical connection at the end of the capillary region here ensures that no fluxing agent enters into the interior of the header to there, for example, react negatively with the internal heat exchange fluid. If a solder connection is not reliable in this respect, the interior of the header must be cleaned in an expensive process so as to free it of penetrated fluxing agent.

The installation of the flat tubes in the slots of the bottom portion of the first component requires a manufacturing technology that is very difficult to realize and additionally leads to weakening of the flat tubes in the insertion region in the header with respect to the effects of bursting pressure. Thus, according to further features of the invention the flat tubes inserted into the receiving slots of the tube bottom of the header are initially separated at the internal dividing walls of the flat tubes and are then opened up in the form of a tulip. The slitting open leads to the mentioned reduction of the burst pressure limit. The opening in the form of a tulip requires complicated tools, particularly with respect to the fact that the flat tubes have a small free inner cross section which is subdivided yet by the partitions.

The invention avoids these difficulties. Without in any way adversely affecting the geometry of the solder connection, it is made possible to completely avoid the cutting into the interior walls of the flat tube and its being bent upward in the manner of a tulip. According to the invention, the tolerance compensation is effected by the tube bottom rather than by the flat tube. For this purpose, beads are pre-shaped in the tube bottom on both sides of the receiving slots. If the tube bottom is curved outwardly these beads project within the tube bottom (if the curvature has an opposite orientation, these beads are disposed in a raised fashion on the exterior of the tube bottom). If these pre-shaped beads are compressed in the direction of the tube bottom curvature, the material in the tube bottom will be deformed. The geometry of the beads extending into the end regions of the curvature of the tube bottom leads to the long sides of the receiving slots coming closer to one another, under the influence of pressure, and the end faces of the receiving slots under the influence of tension, so that the receiving slots approach the flat tubes all around. Depending on the original play between the flat tubes and the receiving slots existing after insertion of the flat tubes into the receiving slots, the beads are reduced in size to a greater or lesser extent although they remain more or less distinct after the final compression in order to maintain full control over the tolerance compensation all the way into the final compression phase. It is acceptable that in the region of the fixed contact between the peripheral edge of the receiving slots and the girth of the flat tubes the latter are dented somewhat along their periphery. It may also happen that during compression, initially flattened beads are pressed through to the other side of the tube bottom; however, this is not the normal case and requires extra high deformation forces.

According to a further feature of the invention, the earlier-noted holding flaps are arranged in such a way that, even after the two components have been mechanically connected, fluxing agent is able to be supplied between the holding flaps so as to produce the solder connection. The fluxing agent is added into a receiving trough formed, for example, in the second component. In this trough, the solder originating from the pre-coating of the components gather together with the fluxing agent during the establishment of the solder connection quite analogously to the procedure for the connection of the tube bottom with the flat tubes.

In the case of the establishment of the solder connection, the mutually engaging faces are previously provided with a preliminary solder coat on at least one face of the overlap zone (generally on the part connected with the tube bottom but not on the cover). But even if the tube bottom is slotted and no preliminary solder coat is provided along the edges of the slots, a solder connection that is reliable in continuous operation is ultimately obtained in the three zones including initially the funnel or wedge shaped entrance zone, then the capillary continuation and finally the mechanically contacting end of the solder connection.

DESCRIPTION OF THE PREFERRED EMBODIMENTS

Figure 1:
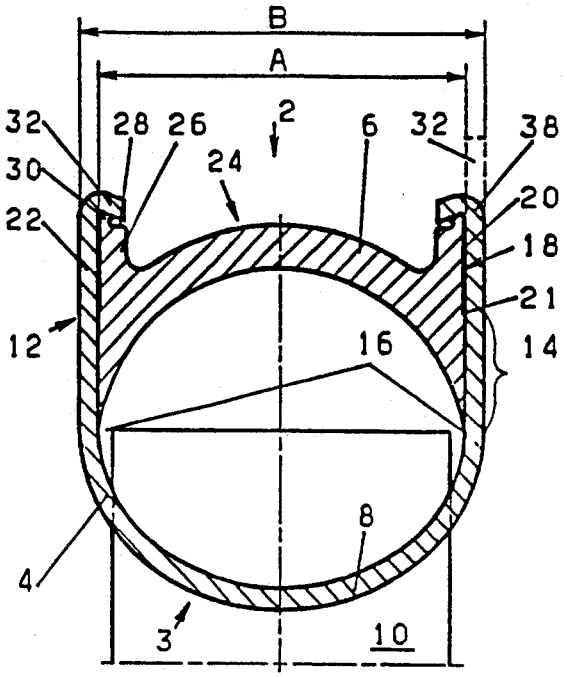
FIGS. 1, 2 and 3 are sectional end elevational views of three different embodiments of a header according to the invention.

Turning to FIG. 1, the peripheral wall of the header 2 for a flat tube liquefier is composed of two components 4 and 6 which extend along the header length oriented perpendicularly to the plane of FIG. 1. The first component 4 includes receiving slots 8 for flat tubes 10 provided in a tube bottom 3 formed therein. The flat tubes are inserted into the header through receiving slots 8. The second component 6 complements the header structure. The first component 4 is shaped from a metal sheet that is covered with solder on both sides, while the second component 6 is an extruded profile that is not covered with solder. Both components 4 and 6 are composed of aluminum or an aluminum alloy, preferably AlMn1 and define, with their inner faces, a tubular header cavity extending along the header length.

The two components 4 and 6 follow one another in two overlap zones 12 that extend along the length of the header 2 and seal the two components 4 and 6 against each another. In each overlap zone 12, a solder connection 14, particularly by brazing, is provided and takes up an annular zone around the annular interior connection groove 16 of boundary face 18 in overlap zone 12. The annular region of boundary face 18 following toward the outside is configured as a continuous undercut 20 on component 6.

Figure 2:
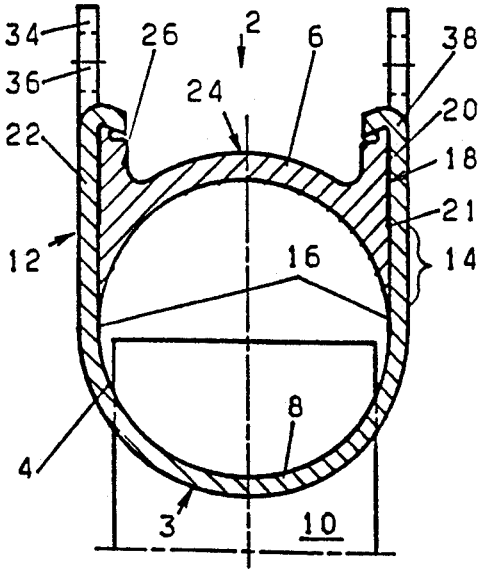
Figure 3:
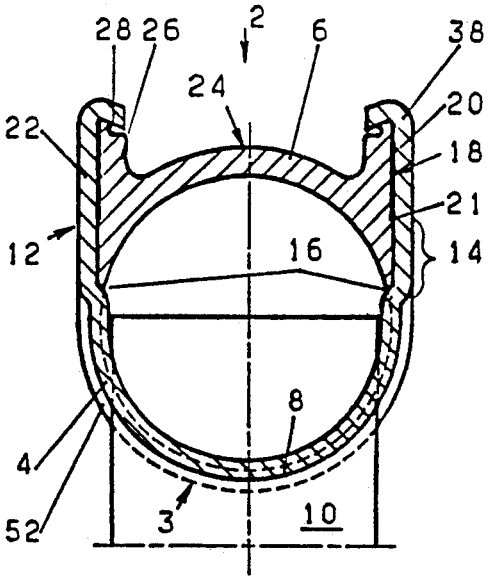

The tube bottom 3 of first component 4 is provided with receiving slots 8 that extend transversely to the length of the header and into which the flat tubes 10 are inserted with only little play. Flat tubes 10 may take up the entire inner width dimension of header 2 and its tube bottom 3, respectively, except for a slight remaining tolerance. The curvature of the tube bottom may be selected in a known manner. In FIG. 1, tube bottom 3 is shown as a flattened and rounded, so-called torospherical head, while the tube bottom in FIG. 3 is semicircular. In both cases, the interior outline of the header is selected so that the complementing second component 6 also describes a semi-circle without limiting its generality. In the case of FIG. 2, this semi-circle is complemented by the semi-circle of the first component 4 to form a full circle. The slight rounding of the second component 6 in the region following connection groove 16 caused by its manufacture as an extruded profile is not emphasized in the drawing.

Figure 1A:
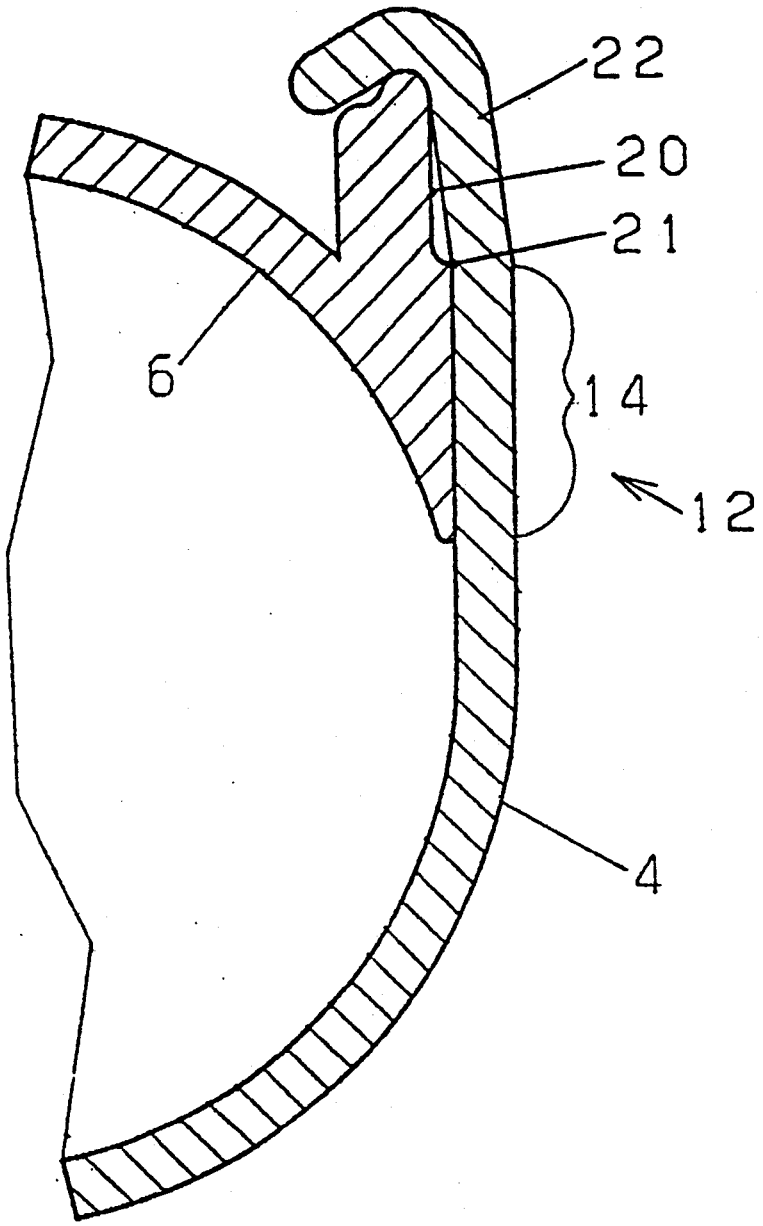
FIG. 1*a* is an enlarged fragmentary sectional elevational view of an identical part of FIGS. 1, 2 and 3 showing further details.

In both embodiments of FIGS. 1 and 2, the tube bottom 3 of component 4 extends with its two mutually essentially parallel side walls 22 over the entire region of overlap zone 12 where it overlaps outer side wall faces of the second component 6. On the component 6, two webs 26 extend parallel to one another away from the header from the exterior face 24 facing away from the tube bottom 3 of first component 4 and parallel to the side walls 22 while forming the overlap zone 12 with the latter. With particular reference to FIG. 1*a*, undercuts 20 are formed essentially at the exterior faces of the webs 26. The respective end face 28 is configured to include an outwardly raised step 30. This step in each case forms a free edge of the second component 6 around which an overhang 32 of the side wall 22 of the first component 4 is bent through an angle of slightly more than 90° but less than 180°. The overhang 32 is bent around step 30 from the starting position shown in dashed lines in FIG. 1. The step 30 initially had a rectangular cross section which in the final state, as shown in the drawing, has been deformed into a rounded shape. The step may be used for the compensation of tolerances and also as means for gripping around the bent-over overhang by more than 90°, that is, to form an undercut behind the free edge of end face 28.

Undercut 20 serves to provide a defined bend-over edge 21 for the overhang of side walls 22 over the solder connection regions 14 of overlap zone 12. Solder zone 14 generally extends over a greater length along the respective overlap zone 12 than the material wall thickness of component 6.

The two side walls 22 are closed at component 4 up to approximately the height of the respective end face 28 of component 6. These two end faces are disposed at the same distance from the exterior face 24 of component 6, but could also be stepped in height relative to one another. The free edges of side walls 22 are divided into equidistant installation tongues 34—each having a fastening hole 36—and holding flaps 38 therebetween. Only these holding flaps 38 form the overhang that is placed around the respective free edge 30 and its step, respectively, while the overhang formed by installation tongues 34 is a linear continuation of the side walls 22.

Figure 4B:
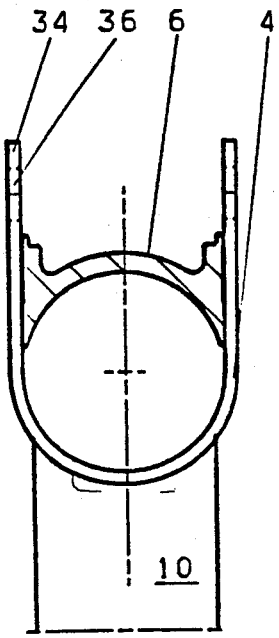
FIG. 4*b* is a front elevational view of the arrangement according to FIG. 4*a*.
Figure 4A:
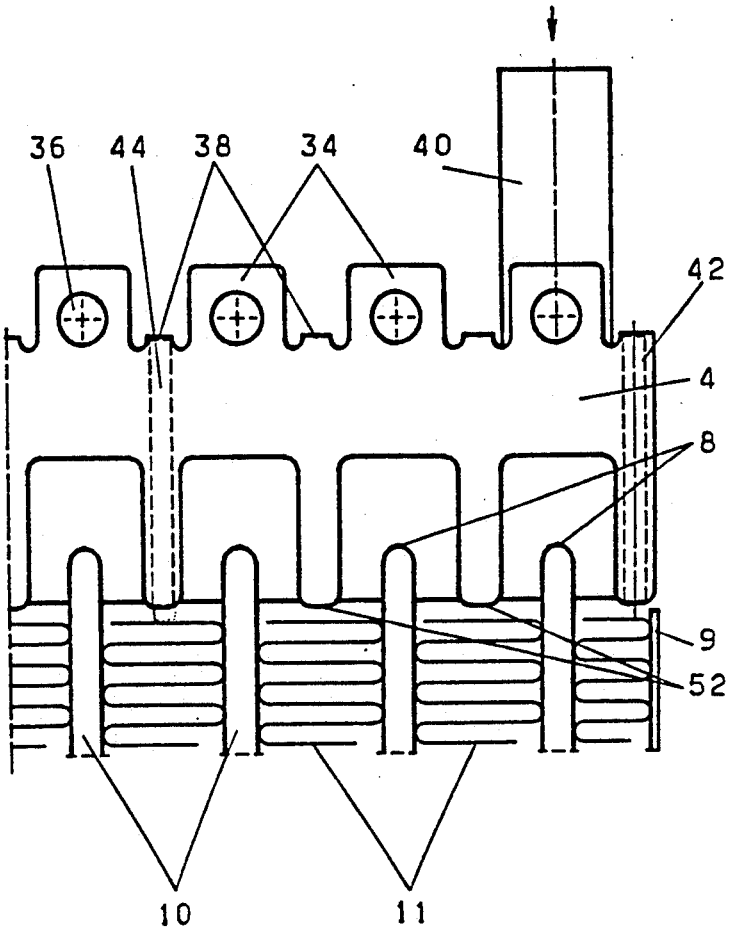
FIG. 4*a* is a schematic side elevational view of a flat tube liquefier having a header according to the invention.

As can be seen particularly in FIG. 4*a*, the installation tongues 34 are disposed along the header in the region of each flat tube 10 and its receiving slot 8 in the first component 4. Also shown in FIG. 4*a* are the heat exchanging ribs 11 of the flat tubes 10, with these ribs preferably being configured in the illustrated shape as plates arranged in a zigzag pattern that are soldered to the flat tubes 10. Like the flat tubes, the ribs are also composed of aluminum or an aluminum alloy, preferably also of AlMn1. In the end region of the flat tube liquefier a metal end sheet 9 is provided at the respective rib 11.

The free inner cross section of header 2 is customarily subdivided by transverse wall members (dividing walls). One type of such dividing walls are end walls 42 which terminate the two end faces of a header constructed in an indeterminate length for a certain flat tube liquefier configuration. If it is not desired to place elbow connections at one side of the flat tubes 10, a header will be arranged at each end of the parallel arranged flat tubes. The one header 2 is provided with an inlet 40 in the region of its own end and with a corresponding outlet (not shown) in the region of its other end. The space between the header inlet and outlet is divided by means of a partition 44. The other header, which need merely connect the ends of the flat tubes with one another, then requires merely two end walls 42. If the stream is divided into multiple back and forth paths, partitions may also be provided within the two headers, generally one partition more in the header provided with the inlet and outlet than in the other header.

As can be seen in particular in FIGS. 3, 4*a*, 5 and 6, in the described header the dividing walls, namely end walls 42 and partitions 44, are discs of the same material as the first component 4 which are adapted to the free cross section of header 2 so as to project slightly on the side of component 4. In the case of the configuration of FIG. 2, from which the structure of FIG. 3 is derived, the dividing walls have an essentially circular disc shape, otherwise in the case of the arrangement of FIG. 1, a flattened rounded shape. For this purpose, end walls 42 and partitions 44 are given the same configuration; they include a continuous annular groove 46 whose two side walls 48 each end in a continuous cutting edge 50 on the circumference. The cutting edges 50 sealingly engage in the interior face of component 6. In contrast thereto, the tube bottom 3 of component 4 is configured to have a constant division along header 2 where exterior beads 52 are provided which form a hollow flute 54 on the interior face of header 2 into which the respective dividing wall 42 or 44 extends to a greater or lesser degree with compensation for tolerances. The final fixation in the header is then effected by soldering. For this purpose, dividing walls 42 and 44 are coated on both sides similarly to the first component 4, as noted before.

The arrangement of the exterior beads 52 and the hollow flutes 54 formed by them also predetermines the spacing of the installation tongues 34 and the holding flaps 38 disposed therebetween at the second component. A holding flap 38 should be, with respect to the longitudinal direction of header 2, locally associated with an existing dividing wall 42 or 44, respectively. Within the scope of the given division along the header, the dividing walls can then be inserted as desired into the respective hollow flute 54.

Figure 5:
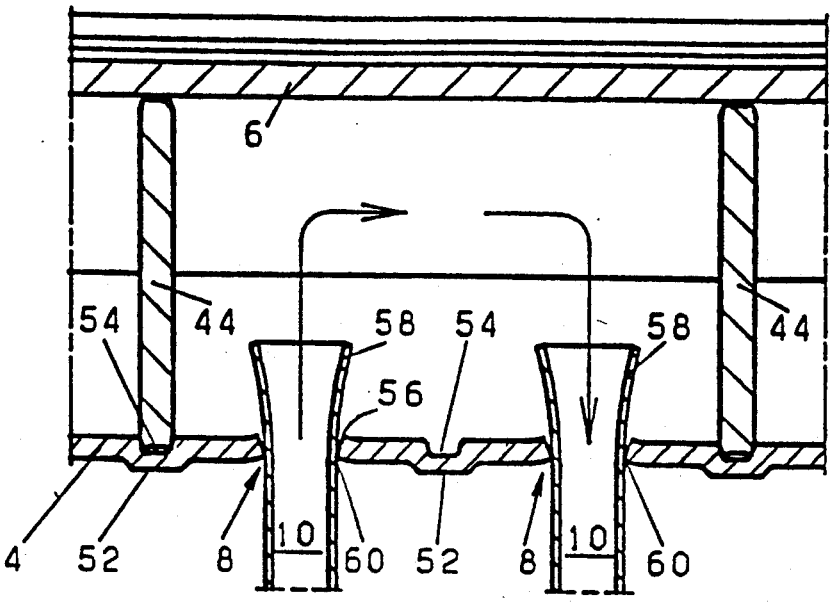
FIG. 5 is a sectional side elevational view of the header according to the invention including two dividing walls and two flat tubes.
Figure 6:
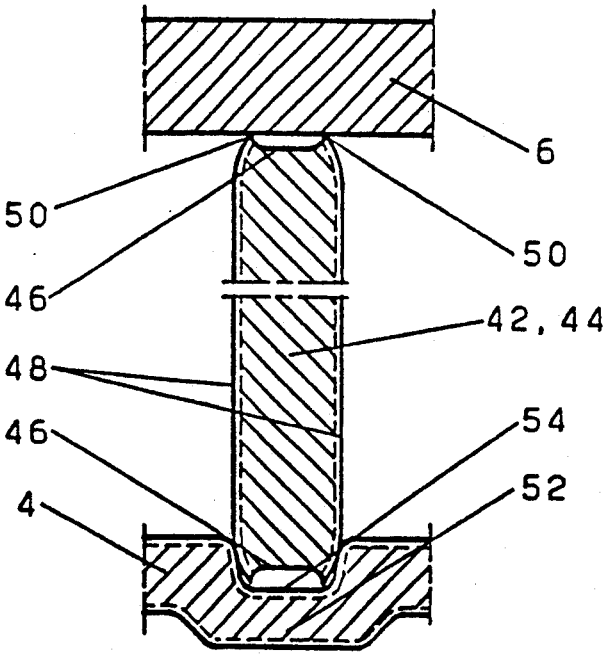
FIG. 6 is a fragmentary sectional side elevational view of the header including an inserted dividing wall.

Finally, it can be seen in FIG. 5 that the receiving slots 8 in tube bottom 3 of the first component 4 are given a funnel-shaped constriction at least along their longitudinal edges 56. If the ends of the flat tubes 10 that are inserted into tube bottom 3 are then provided, as shown in FIG. 5, with a flared configuration 58 for a mechanical hold before the second component 6 is attached, a continuous soldering flute 60 favorable for soldering forms along the exterior of the header.

The manner of arranging the first component 4 so that it always lies on the outside in overlap zone 12 and the second component 6 always lies on the inside then makes it possible for the second component 6 to be disposed not only completely within the outer width dimension B of the first component 4, but even to lie completely within the distance dimension A between the two boundary faces 18 of the two overlap zones 12. The dimension A represents the distance between the inner faces of the two opposite side walls 22. The outer width dimension B of the first component 4 simultaneously describes the outer width dimension of the entire header 2 and represents the distance between the outer faces of the two opposite side walls 22. The header 2 thus projects at its two longitudinal sides, that is, at the outer faces of side walls 22, only slightly more than one wall thickness of the respective side wall 22 beyond the length dimension of the cross section of flat tube 10, with the slight additional overhang being caused by the slight overdimension required for manufacturing reasons between the ends of receiving slots 8 and the respective projected interior face of side walls 22. In this respect, the conditions for installing the flat tubes in the header are identical to those in EP-B1-0,255,313, where the header forms an integral, cylindrical tube, without having to take over the drawbacks of this integral embodiment.

In the header for a flat tube liquefier according to FIGS. 7 to 15, the outer wall of the header 2 for a flat tube liquefier is composed of two components 4 and 6. The first component 4 is provided at a tube bottom 3 with receiving slots 8 for flat tubes 10. The flat tubes are inserted into the header through receiving slots 8. The second component 6 complements the header structure. The first component 4 is a shaped metal sheet that is covered with solder on both sides, while the second component 6 is an extruded profile that is not covered with solder. Both components 4 and 6 are made of aluminum or an aluminum alloy, preferably AlMn1.

The two components 4 and 6 follow one another in two overlap zones 12 extending along header 2 and sealing the two components 4 and 6 against one another. A solder connection 14, preferably by brazing, is provided in each overlap zone 12 and its configuration will be described in greater detail further below.

Figure 7:
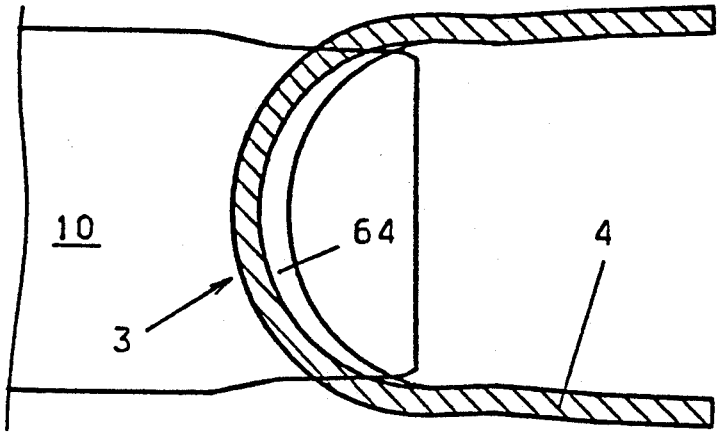
FIG. 7 is a partially sectional end elevational view of the connecting region between a flat tube and the tube bottom of a header component.
Figure 11:
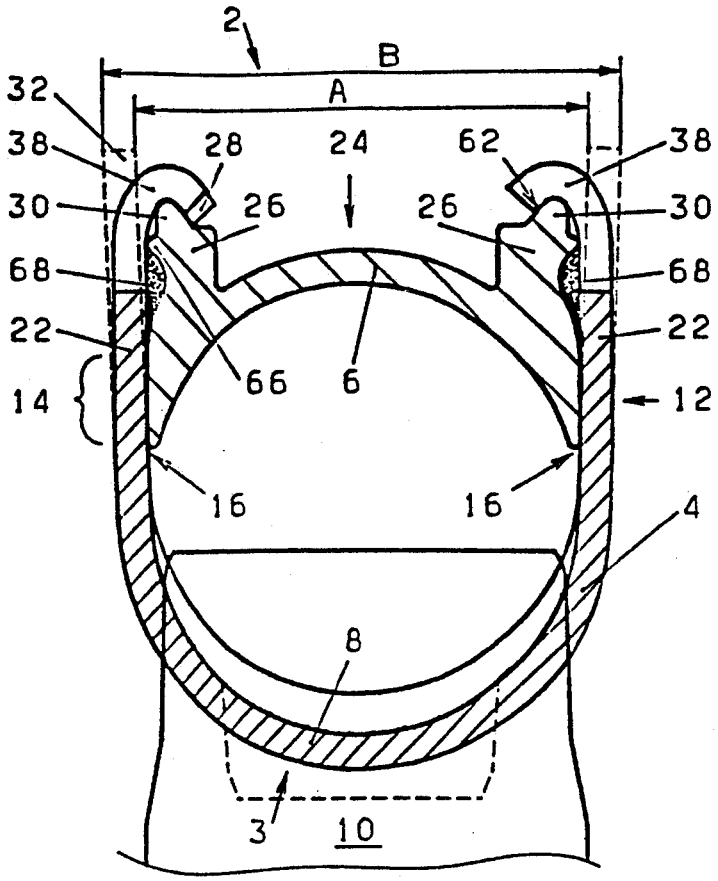
FIG. 11 is a sectional end elevational view of the header according to FIGS. 7 to 10.

The tube bottom 3 of the first component 4 is provided with receiving slots 8 that extend transversely to header 2 and into which the flat tubes 10 enter with only a slight play. Flat tubes 10 may take up the entire inner width dimension of header 2 and its tube bottom 3 except for a very slight remaining tolerance. The curvature and exterior bulge on tube bottom 3 may be selected in a known manner. In FIGS. 7 and 11, tube bottom 3 describes a semi-circle; however, it may also be a flattened, rounded, so-called torospherical head. In both cases, an interior contour has been selected for header 2 in which, without restricting its general application, the complementing second component 6 also describes a semi-circle which together with the semi-circle of the first component 4 forms a full circle.

The tube bottom 3 of component 4 extends by way of two essentially parallel side walls 22 over the entire region of overlap zone 12 with second component 6. Two parallel webs 26 extend at this component 6 from its exterior face 24 facing away from the tube bottom 3 of first component 4 and parallel to side walls 22 while forming an overlap zone 12 with the side walls. The respective end faces 28 of webs 26 are configured to have an outwardly raised step 30 which drops obliquely inwardly with a slope 62. Step 30 forms a free edge of second component 6 around which an overhang 32 (that is, the holding flaps 38 to be described later) of the side wall 22 of first component 4 is placed by a little more than 90° but less than 180° in contact with the slope 62 of step 30. Overhang 32 is bent around step 30 out of its starting position shown in dashed lines in FIG. 11.

The two side walls 22 are initially given a closed configuration at component 4. The free edges of side walls 22 are then divided into equidistant holding flaps 38. These holding flaps 38 form the overhang 32 that is placed around the respective step 30.

Figure 9:
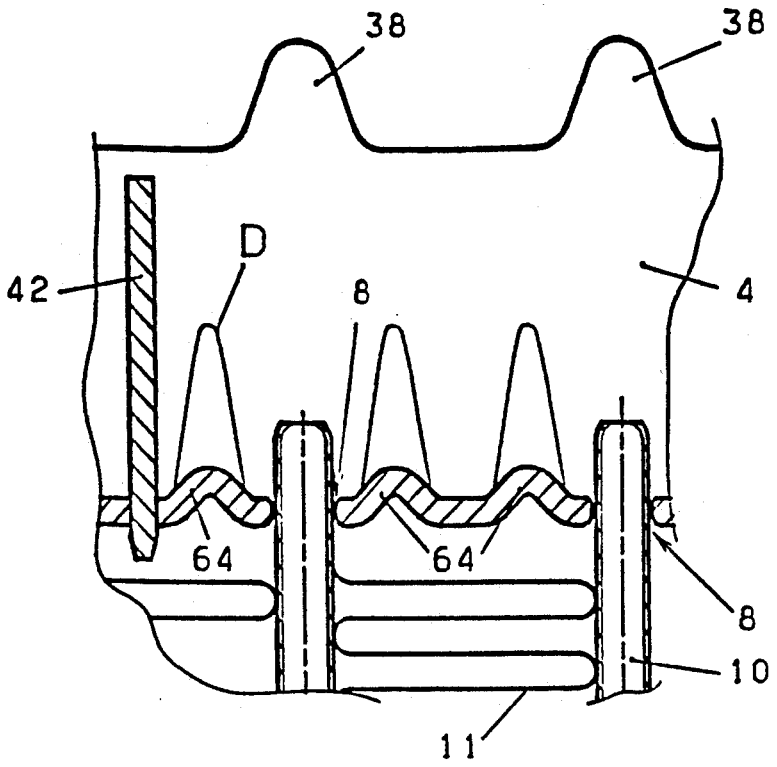
FIG. 9 is a fragmentary sectional side elevational view of part of the header and two inserted flat tubes for the configuration according to FIGS. 7 and 8.
Figure 12:
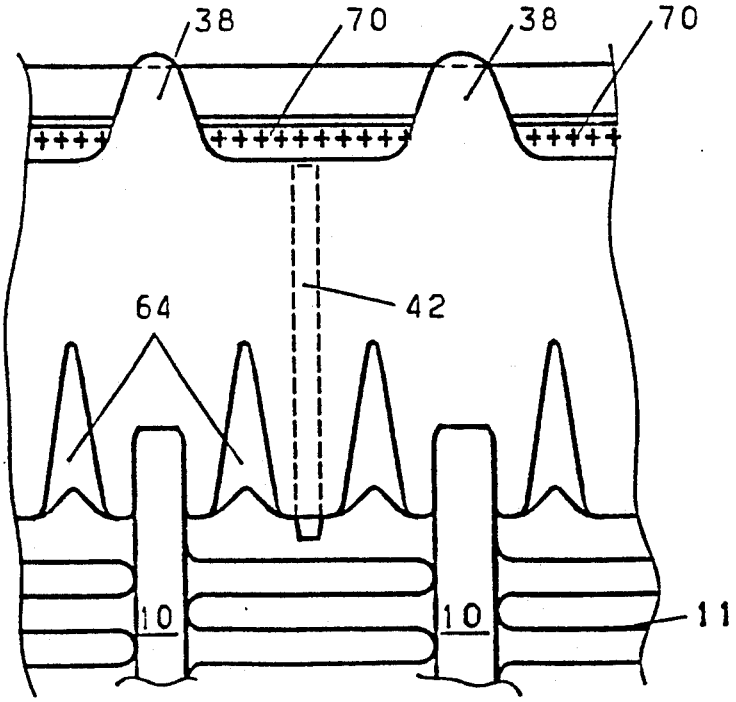
FIG. 12 is a schematic side elevational view of the flat tube heat exchanger according to FIG. 11.

Also seen in FIGS. 9 and 12 are the heat transferring ribs 11 of flat tubes 10. The ribs are plates arranged in a zigzag pattern that are soldered to flat tubes 10 and, like the flat tubes, are made of aluminum or an aluminum alloy, preferably AlMn1. In the end region of the flat tube liquefier provided with header 2, a metal end sheet 9 is provided at the respective rib 11.

The free inner cross section of header 2 is customarily subdivided by dividing walls 42. One type of such dividing walls 42 are end walls which terminate the two end faces of a header 2 constructed in an indeterminate length for a certain flat tube liquefier configuration. If it is not desired to employ elbow connections at one side of the flat tubes 10, a header 2 will be arranged at each end of the parallel arranged flat tubes. The one header 2 is provided with an inlet in the region of its own end and with a corresponding outlet in the region of its other end, with the space between the header inlet and its outlet also being partitioned off by means of a dividing wall 42. The other header 2, which need merely connect the ends of the flat tubes 10 with one another, then requires merely two end walls. If the stream is divided into multiple back and forth paths, dividing walls 42 may also be provided within the two headers 2, generally one dividing wall 42 more in the header 2 provided with the inlet and outlet than in the other header 2.

Dividing walls 42 are discs made of the same material as first component 4 which are adapted to the free cross section of header 2 so as to project slightly on the side of component 4, in an essentially circular disc shape. If a torospherical head is employed, the dividing walls have a flattened rounded shape. For this purpose, the end walls and the partitions are given the same configuration as dividing walls 42. In the one embodiment according to FIGS. 15 and 15*a*, tube bottom 3 of component 4 is configured to have a constant division along header 2 where a groove 52 in the form of an exterior bead is provided which forms a hollow flute on the interior face of header 2 into which the respective dividing wall 42 extends to a greater or lesser degree with compensation for tolerances. The final fixation in header 2 is then effected by soldering. For this purpose, dividing walls 42 are coated on both sides similarly to the first component 4, as noted before.

The arrangement of grooves 52 and the hollow flutes formed by them also predetermines the spacing of the holding flaps 38 at second component 6. A holding flap 38 should have a local reference, with respect to the longitudinal direction of header 2, to an existing dividing wall 42. Within the given division along header 2, the dividing walls 42 can then be inserted as desired into the respective groove 54.

The manner of arranging the first component 4 so that it always lies on the outside in overlap zone 12 and the second component 6 always lies on the inside then makes it possible for the second component 6 to be disposed not only completely within the outer width dimension B of the first component 4, but even completely within the distance dimension A between the two boundary faces 18 of the two overlap zones 12. The outer width dimension B of the first component 4 simultaneously describes the outer width dimension of the entire header 2. The latter thus projects at each of its two longitudinal sides, that is, at the outer faces of side walls 22, only slightly more than one wall thickness of the respective side wall 22 beyond the length dimension of the cross section of flat tube 10, with the slight additional overhang being caused by the slight overdimension required for manufacturing reasons between the ends of receiving slots 8 and the respective projected interior face of side walls 22, except for slope 62.

As can be seen in FIGS. 7 and 11 as well as 13 to 15, the embodiment of FIGS. 7 to 15 is explained for the case of a configuration of the tube bottom with a convex curvature, as this was the case for the embodiment according to FIGS. 1 to 6.

Figure 10:
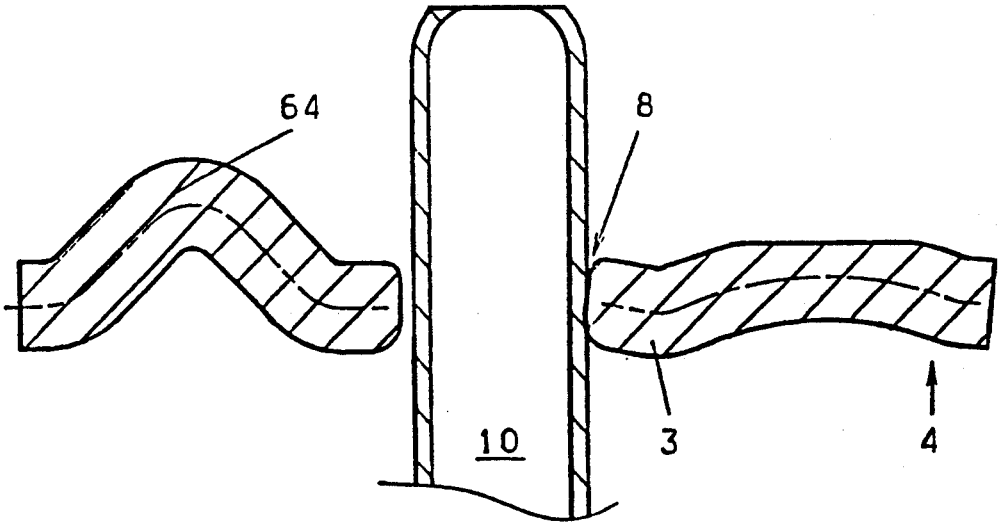
FIG. 10 is an enlarged sectional side elevational view of the connecting region between a flat tube and the tube bottom according to FIG. 9.

In contrast to the embodiment of FIGS. 1 to 6, the flat tube 10 according to FIG. 10 extends without a flared end through receiving slot 8 in tube bottom 3 of component 4. This becomes possible in that, according to FIGS. 7 to 10, a bead 64 is formed in the tube bottom on both sides of receiving slot 8. This bead is disposed on the side of the tube bottom facing toward header 2 and thus away from the curvature of the tube bottom. Bead 64 extends over the entire curved region of the curvature of tube bottom 3 and ends in the end regions of the curvature. This can be seen particularly well in FIG. 7 and in FIG. 8 where the end of the configuration, in a top view, gives an acute-angled, oval image.

The two beads 64 are equidistantly arranged on both sides of the respective receiving slot 8 parallel to its longitudinal extent, so that two beads 64 are disposed between every two receiving slots and another bead 64 is disposed in the respective end regions.

FIG. 7 indicates that beads 64, when seen from the side, have the shape of a slender moon crescent. The same applies, in the same sense, if instead of the arcuate configuration, a more flattened configuration of the type of a torospherical head is selected for the tube bottom.

FIG. 9 is a front view of the crescent-shaped extent of the beads into the ending region of the curvature at D. The view of FIG. 7, the sectional view of FIG. 9 and the illustration on the left side of FIG. 10 correspond to the pre-shaped configuration of the beads with an edge steepness relative to the horizontal in an angular range from 45° to 60°. In the right-hand portion of FIG. 10, the already compressed state is shown in which there is a firm mechanical contact between flat tube 10 and the inner edge of receiving slot 8 after beads 64 have been compressed. The compression of beads 64 is effected in the axial direction of the flat tubes, with an orientation from the interior of header 2 toward the exterior. This corresponds to the orientation of the curvature of the tube bottom according to FIG. 7.

FIGS. 11 and 12 also show the mechanical connection of the flat tubes 10 in receiving slots 8 according to the described arrangement of FIGS. 7 to 10. In combination with these arrangements, the solder connection between the two components 4 and 6 is additionally effected in a novel manner.

Initially a fixed mechanical contact between components 4 and 6 is established in the region of overlap zone 12 by means of a bead 66 which extends continuously on both sides of header 2 on the exterior face of web 26 and about which holding flaps 38 are placed in close contact with step 30 when the flaps are placed around step 30 and its slope 62. In order to compensate tolerances, bead 66 may be deformed to a greater or lesser degree in the direction of the structural depth of header 2. Correspondingly, this is a bead element which has such a small cross section that this tolerance compensating effect is possible, but, on the other hand, the bead may also be shaped onto component 6 which is produced as an extruded profile.

Below the respective bead 66, between the uninterrupted parallel side wall 22 of component 4, on the one hand, and the curved, retreating exterior face of component 6, on the other hand, a wedge-shaped receiving trough 68 is formed in the component 6 along the length of the header 2. The respective side wall 22 extends to the average height between the bottom of receiving trough 68 and bead 66 so that spaces 70 remain between successive holding flaps 38 through which fluxing agent ban still be introduced into receiving trough 68 even after holding flaps 38 have been laid around step 30 and slope 62. In the given configuration, this results in a wedge or funnel shaped entrance region for fluxing agent and solder in the actual cross-sectional region of receiving trough 68 which then changes in its base capillary into the region of firm, material contact with overlap path 22.

Figure 15:
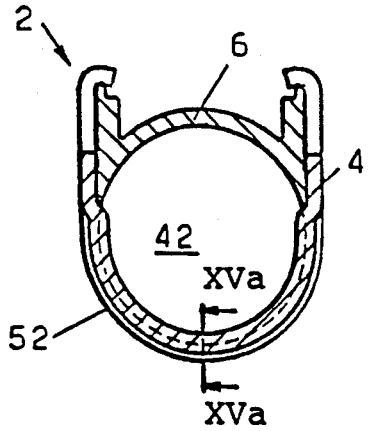
Figure 15A:
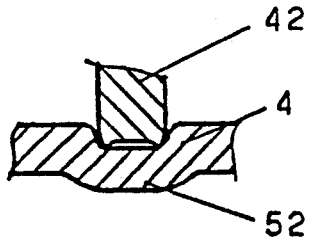
FIG. 15*a* is a sectional view along line XVa—XVa of FIG. 15.

FIG. 15 demonstrates and modifies the concept of the configuration of FIGS. 1 to 6, namely of inserting a dividing wall 42 of the free inner cross section of header 2 into a hollow flute or groove 52 in the bottom of the tube so that dividing wall 42 is held against tilting in the axial direction of header 2. The compression of beads 64, that has already been discussed in connection with the firm attachment of flat tubes 10 in receiving slots 8 and with reference to FIGS. 7 to 10, can also be utilized in a novel manner for this case so as to bring dividing wall 42 into a firm material connection with groove 52 in the case of the arrangement of FIG. 15 as well. FIG. 15*a* shows the engagement of dividing wall 42 in the groove of the embodiment of FIGS. 1 to 6, namely with cutting edges that are arranged in the extension of the two flat sides of dividing wall 42 and engage at the two corners at the bottom of the outwardly sloped groove.

Figure 8:
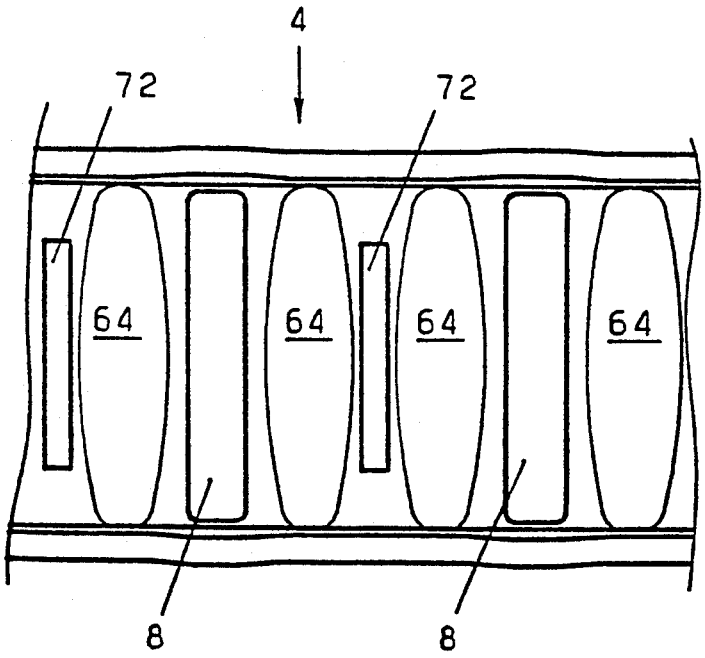
FIG. 8 is a top plan view of the tube bottom according to FIG. 7 seen from the interior of the header.
Figure 13:
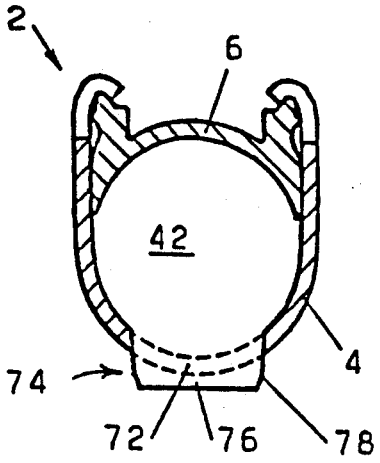
FIGS. 13, 14 and 15 are sectional end elevational views of three embodiments illustrating the arrangement of a dividing wall in a header.

Instead of a groove 52, FIG. 13 provides a holding slot 72 which is also shown in FIG. 8. It has a smaller extension length than the structural depth of dividing wall 42 so that installation of dividing wall 42 in holding slot 72 is possible only from the interior of the header which has not yet been complemented to its full structure. It can be seen in FIG. 8 that such a slot, when seen in a top view, may be at least substantially rectangular. It can also be seen in FIG. 13 that in this case dividing wall 42 has an extension 74 which itself passes completely through holding slot 72 and a continuation 76 which extends beyond the base of the tube bottom and is provided with insertion slopes 78. The form-locking mounting of the continuation 76 in holding slot 72 takes place in an analogous manner to that described above in connection with the mounting of dividing wall 42 in groove 52.

Figure 14:
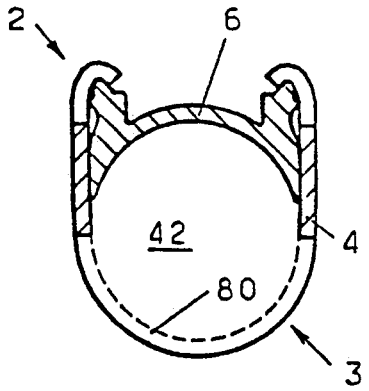
Figure 14A:
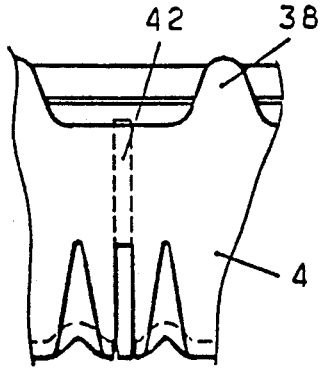
FIG. 14*a* is a side elevational view of FIG. 14.

While FIG. 13 shows a construction where the dividing wall can be installed only from the interior of the header, FIG. 14 shows the opposite. In this case, dividing wall 42 is inserted from the outside into the interior region of header 2 through an insertion slot 80 that extends essentially over the entire extent of the curvature of the tube bottom 3 at component 4 and is then fastened in the insertion slot. For headers that are composed of several components arranged to complement one another in the peripheral direction, this is novel and is further improved within the scope of the present invention in that the seat of dividing wall 42 in insertion slot 80 is again realized, as already described in connection with FIGS. 13 and 14, during the compression of beads 64 in the sense of fastening the flat tubes 10 in tube bottom 3 as shown in FIGS. 7 to 10.

We claim:

1. In a header for a flat tube liquefier; said header having a length and being composed of first and second components extending along said length;

said first component having generally parallel-spaced side walls and a bottom portion interconnecting said side walls; said side walls having inner wall faces oriented toward one another and outer wall faces oriented away from one another; said bottom portion having a series of slots spaced along said length for receiving end portions of flat tubes of said liquefier;

said second component having generally parallel-spaced side walls and a top portion interconnecting the side walls of said second component; said side walls of said second component having outer faces oriented away from one another; said top portion facing said bottom portion and defining therewith a tubular cavity of said header;

said inner wall face of each said side wall of said first component being in a zone of overlap with the outer wall face of each respective side wall of said second component;

a soldered bond provided in each said zone of overlap between adjoining side walls of said first and second components;

the improvement comprising (a) opposite free edge portions forming part of said second component and extending along said length; said free edge portions adjoining the respective side walls of said second component and projecting in a direction away from said bottom portion; and (b) opposite overhang portions forming part of said first component and extending along said length; said overhang portions adjoining respective side walls of said first component and being bent over respective free edge portions of said second component.

2. The header as defined in claim 1, wherein each said overhang portion is bent over each respective free edge portion through an angle more than 90° and less than 180°.

3. The header as defined in claim 1, further wherein each said second component has an undercut portion in said zone of overlap, adjacent said overhang portion.

4. The header as defined in claim 1, further comprising opposite webs projecting from said second component and extending along said length; said free edge portions being formed on each respective web; each said free edge portion has a stepped surface having an elevated portion adjoining each respective side wall of said first component.

5. The header as defined in claim 1, wherein each said slot is defined by adjoining parallel edge faces of said bottom portion; said edge faces being divergent towards said tubular cavity.

6. The header as defined in claim 1, wherein said first component has a width constituting a distance between the inner wall faces of said side walls of said first component; said second component being disposed fully within said width.

7. The header as defined in claim 1, wherein said tubular cavity is defined by curved inner wall faces of said first and second components; the curved inner wall face of said first component changes into the curved inner wall face of the second component with a steady transition.

8. The header as defined in claim 1, wherein said soldered bond is a brazed soldered bond.

9. The header as defined in claim 1, further comprising a series of installation tongues carried by one of said first and second components; said series of installation tongues extending along said length.

10. The header as defined in claim 9, wherein said installation tongues are in alignment with each respective slot.

11. The header as defined in claim 9, wherein said installation tongues are situated at least along one of said overhang portions, adjacent said zone of overlap.

12. The header as defined in claim 9, wherein said installation tongues are carried by said first component.

13. The header as defined in claim 1, in combination with flat tubes inserted into each respective slot, wherein each said slot is flanked by two beads formed in said bottom portion and extending transversely to said length; said beads projecting into said tubular cavity and terminating at locations where said bottom portion is connected to said side walls of said first component; said beads pressing bilaterally against said flat tube in a direction of said bottom portion.

14. The combination as defined in claim 13, wherein said flat tubes have a first length portion situated externally of said first component and a second length portion situated in said respective slot and in said tubular cavity; said second length portion having a circumference being at most equal to a circumference of said first length portion.

15. The combination as defined in claim 13, further comprising a groove provided in said bottom portion and extending transversely to said length, and a partitioning wall obturating said tubular cavity and having a marginal zone held in said groove; said groove being defined by deformed groove walls pressing against the marginal zone of said partitioning wall; said partitioning wall being bonded to said groove walls by a solder connection.

16. The combination as defined in claim 13, further comprising a holding recess provided in said bottom portion and extending transversely to said length, and a partitioning wall obturating said tubular cavity and having a marginal zone held in said holding recess; said holding recess being shorter than a structural depth of said partitioning wall and being defined by deformed recess walls pressing against the marginal zone of said partitioning walls; said partitioning wall being bonded to said recess walls by a solder connection.

17. The combination as defined in claim 13, further comprising a throughgoing holding recess provided in said bottom portion and extending transversely to said length, and a partitioning wall obturating said tubular cavity and having a marginal zone held in said throughgoing holding recess; said partitioning wall being installable into said tubular cavity through said throughgoing holding recess; said throughgoing holding recess being defined by deformed recess walls pressing against the marginal zone of said partitioning wall; said partitioning wall being bonded to said recess walls by a solder connection.

18. The header as defined in claim 1, wherein each said overhang portion is divided into a series of individual holding flaps along said length.

19. The header as defined in claim 18, further comprising a series of installation tongues carried by one of said first and second components; said series of installation tongues extending along said length; further wherein said individual holding flaps and said installation tongues alternate with one another.

20. The header as defined in claim 18, wherein said individual holding flaps are equidistantly spaced along said length.

21. The header as defined in claim 18, further comprising transverse wall members held in the header and oriented transversely to said length; said transverse wall members obturating said tubular cavity; each said transverse wall member being situated adjacent a separate said holding flap.

22. The header as defined in claim 21, further comprising an embossment provided in said bottom portion between two adjoining said slots; said embossment forming a flute in an inner face of said bottom portion; said flute being oriented transversely to said length and receiving a marginal part of one of said transverse wall members.

23. The header as defined in claim 22, wherein each said transverse wall member includes (a) a depressed circumferential edge surface forming a circumferential groove;

(b) opposite side wall faces; and (c) continuous peripheral cutting edges defined by each side wall face of the transverse wall member and the depressed circumferential edge surface.

24. The header as defined in claim 22, wherein each said transverse wall member has opposite side wall faces; said transverse wall members and said first component have a solder coating; and further wherein said second component is free of a solder coating.

25. The header as defined in claim 18, wherein said transverse wall members comprise end walls attached to opposite longitudinal ends of said header.

26. The header as defined in claim 25, wherein said transverse wall members comprise at least one intermediate wall situated between said end walls for partitioning said tubular cavity.

27. The header as defined in claim 1, further comprising receiving troughs for accommodating fluxing agent and solder; said receiving troughs extending along said length adjacent respective said zones of overlap.

28. The header as defined in claim 27, wherein said receiving troughs are formed in said outer faces of said side walls of said second component.

29. The header as defined in claim 28, wherein each said overhang portion is divided into a series of spaced, individual holding flaps along said length; the holding flaps straddling said receiving troughs.

30. The header as defined in claim 29, further comprising a bead provided in said outer face of each said side wall of said second component; each said bead extending along said length adjacent the receiving trough remote from a respective said zone of overlap; said holding flaps being pressed against respective said beads.

31. In a header for a flat tube liquefier; said header having a length and being composed of first and second elongated components extending along said length;

said first component having generally parallel-spaced side walls and a bottom portion interconnecting said side walls; said side walls having inner wall faces oriented toward one another and outer wall faces oriented away from one another; said bottom portion having a series of slots spaced along said length for receiving end portions of flat tubes of said liquefier;

said second component having generally parallel-spaced side walls and a top portion interconnecting the side walls of said second component; said side walls of said second component having outer faces oriented away from one another; said top portion facing said bottom portion and defining therewith a tubular cavity of said header;

said inner wall face of each said side wall of said first component being in a zone of overlap with the outer wall face of each respective side wall of said second component; a soldered bond provided in each said zone of overlap between adjoining side walls of said first and second components;

said header having a dimension constituted by a distance measured between opposite zones of overlap in a direction transverse to said length;

the improvement wherein said second component is situated in its entirety within said dimension.

32. The header as defined in claim 31, wherein said tubular cavity is defined by curved inner wall faces of said first and second components; the curved inner wall face of said first component changes into the curved inner wall face of the second component with a steady transition.

33. In a flat tube liquefier including a plurality of flat tubes and a header; said header having a length and being composed of first and second elongated components extending along said length;

said first component having generally parallel-spaced side walls and a bottom portion interconnecting said side walls; said bottom portion extending along said length and having a series of slots spaced along said length for receiving end portions of said flat tubes of said liquefier;

said second component having generally parallel-spaced side walls and a top portion interconnecting the side walls of said second component; said top portion facing said bottom portion and defining therewith a tubular cavity of said header;

each said side wall of said first component being in a zone of overlap with each respective side wall of said second component;

a soldered bond provided in each said zone of overlap between adjoining side walls of said first and second components;

the improvement wherein each said slot is flanked by two beads formed in said bottom portion and extending transversely to said length; said bead projecting into said tubular cavity and terminating at locations where said bottom portion is connected to said side walls of said first component; said beads pressing bilaterally against said flat tube in a direction of said bottom portion.

34. The flat tube liquefier as defined in claim 33, wherein said flat tubes have a first length portion situated externally of said first component and a second length portion situated in said respective slot and in said tubular cavity; said second length portion having a circumference being at most equal to a circumference of said first length portion.

35. The flat tube liquefier as defined in claim 33, further comprising a groove provided in said bottom portion and extending transversely to said length, and a partitioning wall obturating said tubular cavity and having a marginal zone held in said groove; said groove being defined by deformed groove walls pressing against the marginal zone of said partitioning wall; said partitioning wall being bonded to said groove walls by a solder connection.

36. The flat tube liquefier as defined in claim 33, further comprising a holding recess provided in said bottom portion and extending transversely to said length, and a partitioning wall obturating said tubular cavity and having a marginal zone held in said holding recess; said holding recess being shorter than a structural depth of said partitioning wall and being defined by deformed recess walls pressing against the marginal zone of said partitioning wall; said partitioning wall being bonded to said recess walls by a solder connection.

37. The flat tube liquefier as defined in claim 33, further comprising a throughgoing holding recess provided in said bottom portion and extending transversely to said length, and a partitioning wall obturating said tubular cavity and having a marginal zone held in said throughgoing holding recess; said partitioning wall being installable into said tubular cavity through said throughgoing holding recess; said throughgoing holding recess being defined by deformed recess walls pressing against the marginal zone of said partitioning wall; said partitioning wall being bonded to said recess walls by a solder connection.

38. In a header for a flat tube liquefier; said header having a length and being composed of first and second elongated components extending along said length;

said first component having generally parallel-spaced side walls; and a bottom portion interconnecting said side walls; said bottom portion having a series of slots spaced along said length for receiving end portions of flat tubes of said liquefier;

said second component having generally parallel-spaced side walls and a top portion interconnecting the side walls of said second component; said top portion facing said bottom portion and defining therewith a tubular cavity of said header;

each said side wall of said first component being in a zone of overlap with each respective side wall of said second component;

a soldered bond provided in each zone of overlap between adjoining side walls of said first and second components;

the improvement comprising (a) receiving troughs for accommodating fluxing agent and solder; said receiving troughs extending along said length adjacent each respective zone of overlap;

(b) a series of spaced, individual holding flaps extending along said length; said holding flaps being formed on one of said first and second components and being bent over the other of said first and second components; said holding flaps straddling said receiving troughs; and (c) beads provided in one of said first and second components; each said bead extending along said length adjacent the receiving trough remote from each respective zone of overlap; said holding flaps being pressed against each respective bead.

39. The header as defined in claim 38, wherein said receiving troughs are formed in said outer faces of said side walls of said second component.

* * * * *